US006262536B1

(12) United States Patent
Symons

(10) Patent No.: US 6,262,536 B1
(45) Date of Patent: Jul. 17, 2001

(54) CROWBAR CIRCUIT FOR LINEAR BEAM DEVICE HAVING MULTI-STAGE DEPRESSED COLLECTOR

(75) Inventor: Robert Spencer Symons, Los Altos, CA (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/506,973

(22) Filed: Feb. 18, 2000

(51) Int. Cl.[7] ..... H01J 23/16
(52) U.S. Cl. ..... 315/3; 315/5.38; 315/3.5
(58) Field of Search ..... 315/3, 5.38, 160, 315/224, 291, 241 R; H01J 23/16

(56) References Cited

U.S. PATENT DOCUMENTS

| | | | | |
|---|---|---|---|---|
| 3,644,778 | * | 2/1972 | Mihran et al. | 315/5.38 |
| 4,101,804 | * | 7/1978 | Carlsson | 315/3.5 |
| 4,277,721 | * | 7/1981 | Kosmahl | 315/5.38 |
| 5,440,202 | | 8/1995 | Mathews et al. | 315/3 |
| 5,568,014 | * | 10/1996 | Aoki et al. | 315/3.5 |
| 5,942,852 | * | 8/1999 | Goebel et al. | 315/3.5 |
| 6,111,358 | * | 8/2000 | Cardwell et al. | 315/3.5 |

* cited by examiner

*Primary Examiner*—Don Wong
*Assistant Examiner*—Trinh Vo Dinh
(74) *Attorney, Agent, or Firm*—O'Melveny & Myers LLP

(57) ABSTRACT

A linear beam device having a multi-stage depressed collector is provided with a single crowbar circuit that quickly removes all voltages from the collector electrodes upon detection of an arc between the collector electrodes. The linear beam device comprises a cathode and an anode spaced therefrom that are operable to form and accelerate an electron beam. A collector having a plurality of successive collector electrodes is arranged downstream from the anode to collect electrons of the electron beam. At least one power supply is coupled to the collector and provides a plurality of distinct voltage levels to respective ones of the collector electrodes. The power supply comprises a plurality of serially coupled filter capacitors, with each one of the filter capacitors being charged to a respective difference between adjacent ones of the distinct voltage levels. A crowbar circuit is coupled across the plurality of filter capacitors. The crowbar circuit reduces the total voltage across the plurality of filter capacitors to zero upon detection of an arc between any two of the collector electrodes. According to an embodiment of the invention, the power supply further comprises a plurality of diodes respectively coupled across the plurality of serially coupled filter capacitors. The diodes prevent reversal of voltage of a corresponding one of the filter capacitors upon operation of the crowbar circuit.

22 Claims, 3 Drawing Sheets

CROWBAR CIRCUIT FOR LINEAR BEAM DEVICE HAVING MULTI-STAGE DEPRESSED COLLECTOR

BACKGROUND OF THE INVENTION

1. Field of the Invention

The present invention relates to linear beam devices having multi-stage depressed collectors. More particularly, the invention relates to a crowbar circuit for use in protecting a linear beam device from damage due to arcing between the internal electrodes by quickly removing voltages from each of the electrodes upon detection of an arcing condition.

2. Description of Related Art

Linear beam electron devices are used in sophisticated communication and radar systems that require amplification of a radio frequency (RF) or microwave electromagnetic signal. Conventional klystrons, traveling wave tubes and inductive output tubes are examples of linear beam electron devices. In a linear beam device, an electron beam originating from an electron gun having a cathode is accelerated by a voltage differential with an anode spaced from the cathode. The electron beam passes through a drift tube containing an RF interaction structure. The electron beam may be amplitude modulated by applying an RF input signal between a grid and the cathode. Alternatively, the RF interaction structure of the drift tube may further include an RF circuit used to induce a modulation on the electron beam. Either way, the modulation results in electron bunching due to electrons that have had their velocity increased gradually overtaking those that have been slowed. The accelerated electrons of the electron beam give up varying amounts of their energy to the RF electric fields of traveling or standing wave circuits of the RF interaction structure. The energy removed from the electron beam in this manner may be subsequently removed from the device in the form of an amplified RF signal.

A known technique for increasing the efficiency of a linear beam device is to collect the electrons of the electron beam after they pass through the RF interaction structure using a multi-stage depressed collector. A multi-stage depressed collector includes plural collector electrodes that are each connected to power supplies that provide DC voltages ranging between the cathode potential and the maximum potential to which the electrons of the beam were accelerated. The spent electrons of the beam have various energy levels remaining as they exit the RF interaction structure, and the electrons are collected on individual ones of the collector electrodes having DC voltage levels corresponding to their remaining energy level. This way, it is possible to recover some of the remaining energy of the spent electrons that was not given up to the RF electric fields without losing this energy from conversion into heat.

A drawback with high power linear beam devices is that they sometimes arc internally, and it then becomes necessary to quickly remove all voltages from the device in order to prevent damage to the internal electrodes. By way of example, an electric arc that delivers one Joule of energy to a copper electrode can leave a hemispherical pit slightly over one millimeter in diameter. The filter capacitors of the power supplies -connected to the electrodes of a high power linear beam device typically store energy on the order of thousands of Joules. Thus, an arc discharge from one of the filter capacitors could cause substantial damage to the internal electrodes. To avoid such catastrophic events from occurring, it is known to connect each filter capacitor to a spark-gap, or "crowbar," circuit to discharge the capacitor and thereby remove the stored energy very quickly (i.e., within a few microseconds) after an arc is sensed. A single crowbar circuit has been impractical when multi-stage depressed collectors are used with a linear beam device, since each collector electrode generally utilizes a separate power supply and an associated filter capacitor to provide the corresponding voltage, and thus a separate crowbar circuit would generally be included with each filter capacitor. This duplication of circuitry tends to substantially increase the complexity and hence the cost of equipment using such a high power linear beam device.

Accordingly, it would be very desirable to provide a linear beam device with a multi-stage depressed collector in which only a single crowbar circuit is needed to remove voltages from all of the internal electrodes of the device upon the detection of an arc.

SUMMARY OF THE INVENTION

The present invention provides a linear beam device having a multi-stage depressed collector in which a single crowbar circuit can quickly remove all voltages from the collector electrodes upon detection of an arc.

More particularly, the linear beam device comprises a cathode and an anode spaced therefrom. The anode and cathode are operable to form and accelerate an electron beam. A collector having a plurality of successive collector electrodes is arranged downstream from the anode to collect electrons of the electron beam. A power supply conditions electrical power from an input AC line and provides a plurality of distinct voltage levels to respective ones of the collector electrodes relative to the cathode. The power supply comprises a plurality of serially coupled filter capacitors, with each one of the filter capacitors being charged to the difference between adjacent ones of the distinct voltage levels. A single crowbar circuit is coupled across the plurality of filter capacitors. The crowbar circuit reduces the total voltage across the plurality of filter capacitors to zero upon detection of an arc between any two of the collector electrodes.

According to an embodiment of the invention, the power supply further comprises a plurality of diodes respectively coupled across the plurality of serially coupled filter capacitors. The diodes prevent reversal of the voltage of a corresponding one of the filter capacitors upon operation of the crowbar circuit. In another embodiment of the invention, a current sensing device is associated with plural ones of the collector electrodes in order to detect arc current between any two of the collector electrodes. The current sensing device can detect arc current flowing either to or from at least one of the collector electrodes. The current sensing device may further comprise a transformer coupled to at least one of said collector electrodes and a bridge rectifier coupled to the transformer.

A more complete understanding of the crowbar circuit for a linear beam device having a multi-stage depressed collector will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention satisfies the need for a crowbar circuit for a linear beam device having a multi-stage depressed collector to remove voltages from each of the internal electrodes upon the detection of an arc. In the detailed description that follows, like element numerals are used to describe like elements illustrated in one or more of the figures.

Figure 1:
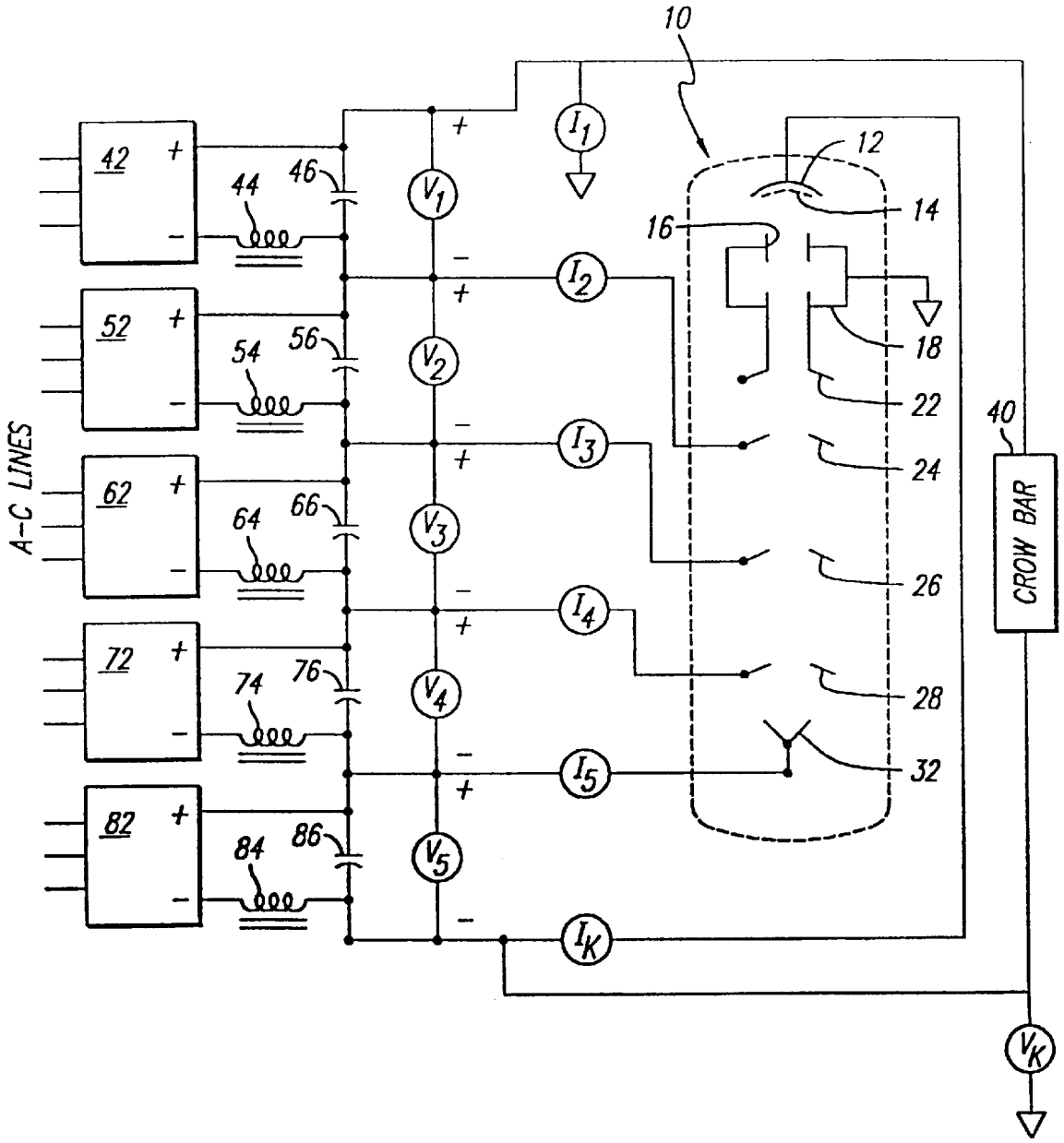
FIG. 1 is a block diagram of a first embodiment of a linear beam device having a multi-stage depressed collector with a single crowbar circuit coupling all electrode stages.

Referring first to FIG. 1, an exemplary linear beam device 10 comprises a generally cylindrical-shaped tube having a thermionic cathode 12 disposed at a first end thereof. A control grid 14 is positioned closely adjacent to the surface of the cathode 12, and an anode 16 is disposed downstream from the cathode and control grid. The anode 16 defines an opening into a drift tube through which a beam of electrons emitted by the cathode 12 are drawn. The drift tube includes a gap that is coupled to a cavity 18. The linear beam device 10 further includes a multi-stage depressed collector that includes a plurality of collector electrode stages 22, 24, 26, 28 and 32. As shown in FIG. 1, the anode 16 is coupled to ground, and a highly negative voltage ($V_K$) is applied to the cathode 12, which draws a beam of electrons therefrom. The electron beam may be density modulated by a control signal applied to the grid 14, thereby inducing an output voltage in the cavity 18. After passing the cavity 18, the electrons of the electron beam are collected on the various electrode stages 22, 24, 26, 28 and 32.

The electrode stages each have different respective voltages applied thereto ranging between the anode voltage (e.g., ground) and the cathode voltage ($V_K$). More particularly, the first electrode stage 22 is electrically connected to the anode 16 and is at ground potential. $V_1$ is the potential between the first and the second electrode stages 22, 24. $V_2$ is the potential between the second and third electrode stages 24, 26. $V_3$ is the potential between the third and fourth electrode stages 24, 26. $V_4$ is the potential between the fourth and fifth electrode stages 26, 28. $V_5$ is the potential between the fifth electrode stage 32 and the cathode 12. The cathode voltage $V_K$ is equal to the sum of the foregoing voltage potentials $V_1$ through $V_5$. As known in the art, the voltage applied to each successive collector electrode is generally an increasing percentage of the cathode voltage, with the fifth electrode stage 32 being at or near the cathode voltage ($V_K$). The current flowing to/from the electrodes stages 24, 26, 28, and 32 is identified in FIG. 1 as $I_2$, $I_3$, $I_4$, and $I_5$, respectively. The current flowing to the cathode 12 is identified as $I_K$, and the current flowing to ground is identified as $I_1$.

Persons having ordinary skill in the art will recognize the exemplary linear beam device 10 illustrated in FIG. 1 as comprising an inductive output tube. An example of an inductive output tube having a multi-stage depressed collector is provided by U.S. Pat. No. 5,650,751, for INDUCTIVE OUTPUT TUBE WITH MULTISTAGE DEPRESSED COLLECTOR PROVIDING NEAR CONSTANT EFFICIENCY, which is incorporated by reference herein. Nevertheless, it should be appreciated that the present invention is not limited to use with inductive output tubes. Particularly, it is anticipated that the present invention be utilized with any type of linear beam device utilizing a multi-stage depressed collector, such as a klystron or traveling wave tube.

Further, the number of collector electrodes shown in FIG. 1 are entirely exemplary, and the present invention would be applicable to a linear beam device having any number of electrodes.

As shown in FIG. 1, the voltages $V_1$ through $V_5$ are provided by separate power supplies 42, 52, 62, 72 and 82 coupled together in series. The power supplies 42, 52, 62, 72 and 82 receive an alternating current (AC) input that may be single-phase, bi-phase or poly-phase. The power supplies may further comprise half-wave or full-wave rectification as generally known in the art, depending upon the particular power requirements of the linear beam device 10. Each power supply provides a direct current (DC) output between positive (+) and negative (−) output terminals thereof, with a filter circuit comprising a capacitor and an inductor coupled to the output terminals. Particularly, power supply 42 has a filter circuit comprising inductor 44 and capacitor 46; power supply 52 has a filter circuit comprising inductor 54 and capacitor 56; power supply 62 has a filter circuit comprising inductor 64 and capacitor 66; power supply 72 has a filter circuit comprising inductor 74 and capacitor 76; and power supply 82 has a filter circuit comprising inductor 84 and capacitor 86. The filter capacitors 46 through 86 are coupled together in series. The aforementioned voltages $V_1$ through $V_5$ are thereby defined across the filter capacitors 46 through 86, respectively. The power supplies 42 through 82 may be provided by variable voltage transformers, power conditioners or phase control circuits using solid state or gas tube components, enabling the DC output voltages to be varied as desired by a particular application. Alternatively, if variable voltage control is not desired, the power supplies could be provided by fixed transformers, or a single transformer having plural secondary windings with one or more associated rectifier circuits. Such power supplies are generally well known in the art, and further description herein is therefore deemed unnecessary.

For the reasons described above, it is desirable to reduce all of the voltages $V_1$ through $V_5$ to zero as quickly as possible upon detection of an arc between any two of the aforementioned collector electrodes 22, 24, 26, 28, and 32, or between the cathode 12 and the anode 16 connected to the first collector electrode 22. To accomplish this, in a first embodiment of the invention, a single crowbar circuit 40 is coupled across the serially coupled capacitors 46 though 86. More particularly, the crowbar circuit 40 has a first lead connected to the positive terminal of the first power supply 42 and a second lead connected to the negative terminal of the fifth power supply 82 such that the entire voltage across the capacitors 46 through 86 may be shorted to zero. The crowbar circuit 40 comprises a high speed switch, and may be provided by an ionized plasma switch, such as a tetrode, pentode or triode thyratron, or ignition or triggered spark gap device, or a solid state switch, such as a field effect transistor (FET).

A drawback of this first embodiment of the invention is that the crowbar circuit 40 does not necessarily shunt all of the stored energy of the capacitors to ground, even though the total voltage across the serially coupled capacitors equals zero. When the crowbar circuit 40 closes, the same current will flow through all of the capacitors 46 through 86. If the capacitors are of unequal capacitance and/or are charged to unequal voltages, the discharge will end when there is no voltage across the crowbar circuit 40, i.e., the sum of the voltages $V_1$ through $V_5$ will be equal to zero. The final voltages ($V_f$) across the capacitors nevertheless will be positive and negative as determined in accordance with the following equation:

$$V_f = V_0 + \frac{1}{C}\int_0^{\infty} i dt$$

in which i is the current, C is the capacitance of the individual capacitor, $V_0$ is the initial voltage across the capacitor, and wherein the current i falls to zero at time t equal to infinity. For a string of n capacitors of differing capacitance ($C_i$), charged to differing initial voltages ($V_{0i}$), connected in series so that a total voltage ($V_t$) and a capacitance ($C_t$) exist across the string, the final voltage ($V_{fi}$) across each capacitor following shorting by the crowbar is determined in accordance with the following equation:

$$V_{fi} = V_{0i} - V_t \frac{C_t}{C_i}$$

Notably, the final voltage ($V_{fi}$) across each capacitor is independent of any resistance in the circuit. This will not provide the desired situation after a crowbar operation. For example, if an arc should occur between two of the collector electrodes of FIG. 1 (e.g., electrodes 24, 26), the capacitor 56 between these two electrodes would be partially discharged by the arc before the crowbar circuit 40 is triggered. Then, when the crowbar circuit 40 triggers, charge present in the other capacitors will recharge the capacitor 56 between the arcing electrodes with the opposite polarity. As a result, each of the capacitors will be charged to a final voltage ($V_f$), even though the total voltage will be zero.

Figure 2:
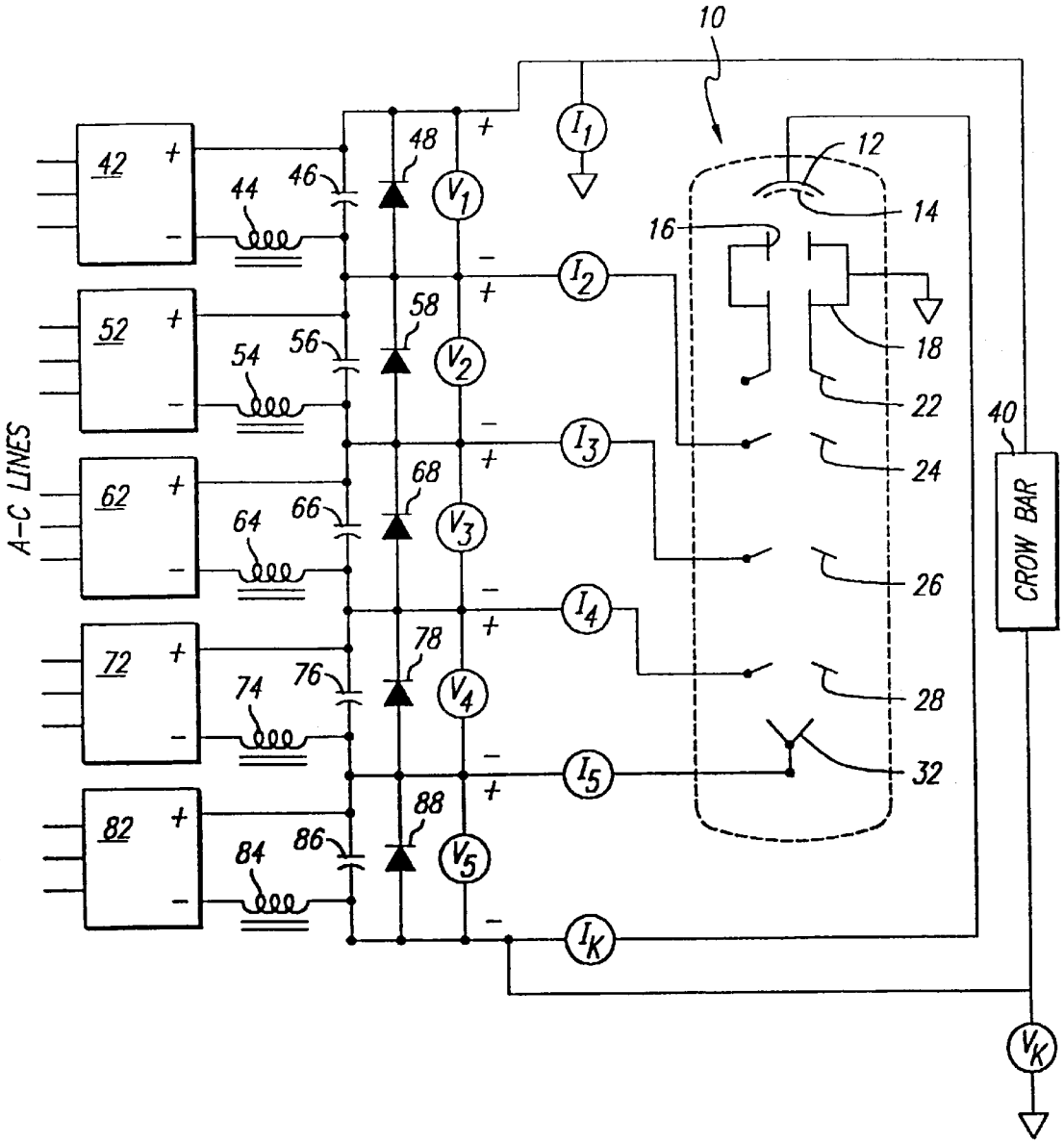
FIG. 2 is a block diagram of a second embodiment of a linear beam device as in FIG. 1, with diodes used to block voltage reversal of filter capacitors during operation of the crowbar circuit.

FIG. 2 illustrates a second embodiment of the invention that is substantially identical to the first embodiment described above, except that a high-voltage, high-current diode is coupled across each respective capacitor. Particularly, diode 48 is coupled across capacitor 46, diode 58 is coupled across capacitor 56, diode 68 is coupled across capacitor 66, diode 78 is coupled across capacitor 76, and diode 88 is coupled across capacitor 86, with the anode of each respective diode coupled to the positive (+) terminal of the corresponding power supply. All other elements of FIG. 2 are otherwise identical to FIG. 1 described above, and description of these elements is therefore not repeated herein. When the crowbar circuit 40 is triggered, current will flow through a corresponding diode after the voltage across the associated capacitor falls to zero, thereby preventing the capacitor from being recharged to a negative voltage as occurred in the embodiment of FIG. 1. Accordingly, when the crowbar circuit 40 is triggered, the voltage across each capacitor will fall to zero in a succession determined by the amount of charge in each capacitor and its corresponding capacitance. As a result, all arcs occurring in the linear beam device 10 will be extinguished and the final voltage ($V_f$) across each capacitor will be zero.

Figure 3:
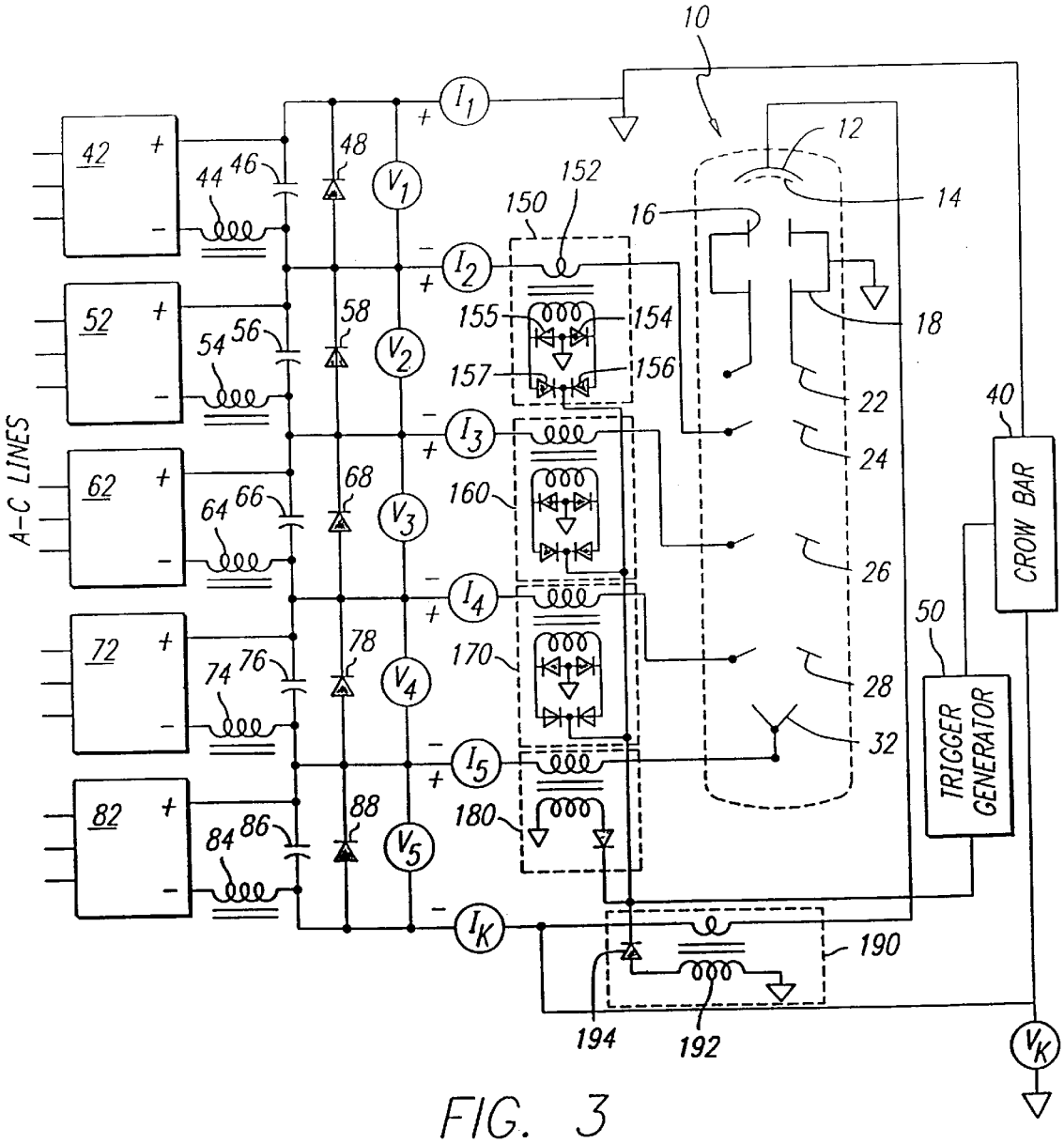
FIG. 3 is a block diagram of a third embodiment of a linear beam device as in FIGS. 1 and 2, with current sensing devices used for triggering the crowbar circuit.

FIG. 3 illustrates a third embodiment of the invention that is substantially identical to the second embodiment described above, further including plural current sensing devices to detect arcing conditions on the various electrodes of the linear beam device 10 and a trigger generator 50. The crowbar circuit 40 is triggered by arc current flowing in any two or more of the leads from the power supplies to the corresponding collector electrodes. Such arc currents may be sensed with a current transformer on each lead, but the direction of the current flow cannot be known in advance except in the most positive and most negative leads. Thus, in an embodiment of the invention, current sensing devices are provided on certain leads in order to detect arc current flowing either to or from a corresponding electrode. The trigger generator 50 receives signals from plural current sensing devices and provides a trigger signal to the crowbar circuit 40 if the detected current exceeds a predetermined level.

Particularly, the linear beam device 10 is provided with current sensing devices 150, 160, 170, 180 and 190. Current sensing device 150 detects the current 12 flowing to/from the second collector electrode 24; current sensing device 160 detects the current 13 flowing to/from the third collector electrode 26; current sensing device 170 detects the current 14 flowing to/from the fourth collector electrode 28; current sensing device 180 detects the current 15 flowing to the fifth collector electrode 24; and current sensing device 190 detects the current $I_K$ flowing to the cathode 12. The current sensing device 150 comprises a transformer 152 and a bridge rectifier comprising diodes 154, 155,156 and 157. The bridge rectifier provides a DC current signal to the trigger generator 50. The current sensing devices 160 and 170 have identical construction as the current sensing device 150, and are adapted to detect current flowing either to or from the corresponding collector electrode. For example, the current sensing device 150 is adapted to detect current flowing either to or from the second collector electrode 24, since an arc may occur either between the first and second collector electrodes 22, 24 or between the second and third collector electrodes 24, 26. The current sensing devices 180 and 190 are adapted to detect current flowing in only a single direction, as they are coupled to the most positive and negative electrodes, respectively. Current sensing device 190 includes a transformer 192 and a diode 194, and current sensing device 180 has substantially identical construction. It should be appreciated that other known types of current sensing devices, such as utilizing series resistors rather than transformers, could also be advantageously utilized.

Arc current detected by any one of the current sensing devices 150, 160, 170, 180 and 190 that exceeds a predetermined threshold will be sufficient to cause the trigger generator 50 to generate the trigger signal. The diodes of the current sensing devices 150 through 190 (see, e.g., diodes 156, 157 of current sensing device 150, and diode 194 of current sensing device 190) preclude current from flowing back into the current sensing devices from any other one of the current sensing devices. As a result, the current sensing devices provide a logical OR function, whereby detected arc current from current sensing device 150 or current sensing device 160 or current sensing device 170 or current sensing device 180 or current sensing device 190 will cause the trigger generator 50 to generate the trigger signal.

Having thus described a preferred embodiment of a crowbar circuit for a linear beam device having a multi-stage depressed collector, it should be apparent to those skilled in the art that certain advantages of the within system have been achieved. It should also be appreciated that various modifications, adaptations, and alternative embodiments thereof may be made within the scope and spirit of the present invention. The invention is defined by the following claims.

What is claimed is:

1. A linear beam device, comprising:

a cathode and an anode spaced therefrom, said anode and said cathode being operable to form and accelerate an electron beam;

a collector having a plurality of successive collector electrodes arranged to collect electrons of said electron beam;

at least one power supply coupled to said collector and providing a plurality of distinct voltage levels to respective ones of said plurality of successive collector electrodes, said at least one power supply comprising a plurality of serially coupled filter capacitors, wherein each one of said plurality of filter capacitors being charged to a respective difference between adjacent ones of said distinct voltage levels; and a single crowbar circuit coupled across said plurality of filter capacitors, said crowbar circuit being adapted to reduce the total voltage across said plurality of filter capacitors to zero upon detection of an arc between any two of said plurality of collector electrodes.

2. The linear beam device of claim 1, wherein said at least one power supply further comprises a plurality of diodes respectively coupled across said plurality of serially coupled filter capacitors, each one of said plurality of diodes preventing voltage reversal of a corresponding one of said plurality of filter capacitors upon operation of said crowbar circuit.

3. The linear beam device of claim 1, further comprising means for detecting arc current between any two of said plurality of collector electrodes.

4. The linear beam device of claim 3, wherein said detecting means further comprises means for detecting current either to or from at least one of said plurality of collector electrodes.

5. The linear beam device of claim 3, wherein said detecting means further comprises a transformer coupled to at least one of said collector electrodes and a bridge rectifier coupled to said transformer.

6. The linear beam device of claim 1, further comprising a drift tube disposed between said anode and said collector, said drift tube having an RF interactive region.

7. The linear beam device of claim 1, wherein said crowbar circuit further comprises an ionized plasma switch.

8. The linear beam device of claim 1, wherein said crowbar circuit further comprises a solid state switch.

9. The linear beam device of claim 1, wherein said at least one power supply further comprises a plurality of power supplies, each one of said plurality of power supplies corresponding to said difference between adjacent ones of said plurality of distinct voltage levels.

10. The linear beam device of claim 1, wherein said at least one power supply further comprises a single voltage transformer having a plurality of secondary winding taps, each one of said plurality of secondary winding taps corresponding to a respective one of said plurality of distinct voltage levels.

11. The linear beam device of claim 1, wherein said crowbar circuit is further adapted to reduce the total voltage across said plurality of filter capacitors to zero upon detection of an arc between said cathode and any one of said plurality of collector electrodes.

12. A linear beam device, comprising:

a cathode and an anode spaced therefrom, said anode and said cathode being operable to form and accelerate an electron beam;

a collector having a plurality of successive collector electrodes arranged to collect electrons of said electron beam;

at least one power supply coupled to said collector and providing a plurality of distinct voltage levels to respective ones of said plurality of successive collector electrodes, said at least one power supply comprising a plurality of serially coupled filter capacitors, wherein each one of said plurality of filter capacitors being charged to a respective difference between adjacent ones of said distinct voltage levels; and means for reducing the total voltage across said plurality of filter capacitors to zero upon detection of an arc between any two of said plurality of collector electrodes.

13. The linear beam device of claim 12, wherein said at least one power supply further comprises a plurality of diodes respectively coupled across said plurality of serially coupled filter capacitors, each one of said plurality of diodes preventing voltage reversal of a corresponding one of said plurality of filter capacitors upon operation of said crowbar circuit.

14. The linear beam device of claim 12, further comprising means for detecting arc current between any two of said plurality of collector electrodes.

15. The linear beam device of claim 14, wherein said detecting means further comprises means for detecting current either to or from at least one of said plurality of collector electrodes.

16. The linear beam device of claim 14, wherein said detecting means further comprises a transformer coupled to at least one of said collector electrodes and a bridge rectifier coupled to said transformer.

17. The linear beam device of claim 12, further comprising a drift tube disposed between said anode and said collector, said drift tube having an RF interactive region.

18. The linear beam device of claim 12, wherein said voltage reducing means further comprises an ionized plasma switch.

19. The linear beam device of claim 12, wherein said voltage reducing means further comprises a solid state switch.

20. The linear beam device of claim 12, wherein said at least one power supply further comprises a plurality of power supplies, each one of said plurality of power supplies corresponding to a respective one of said plurality of distinct voltage levels.

21. The linear beam device of claim 12, wherein said at least one power supply further comprises a voltage transformer having a plurality of secondary winding taps, each one of said plurality of secondary winding taps corresponding to a respective one of said plurality of distinct voltage levels.

22. The linear beam device of claim 12, wherein said reducing means further comprises means for reducing the total voltage across said plurality of filter capacitors to zero upon detection of an arc between said cathode and any one of said plurality of collector electrodes.

* * * * *